United States Patent [19]

Hill et al.

[11] 3,975,145

[45] Aug. 17, 1976

[54] OPEN COIL HEAT SHIELDING

[75] Inventors: Robert R. Hill, Westlake; Robert J. Beemer, Bay Village, both of Ohio

[73] Assignee: Lee Wilson Engineering Company, Inc., Cleveland, Ohio

[22] Filed: Mar. 26, 1975

[21] Appl. No.: 562,251

Related U.S. Application Data

[62] Division of Ser. No. 465,428, April 29, 1974, Pat. No. 3,904,356.

[52] U.S. Cl. ..... 432/10; 432/6; 432/249; 432/260

[51] Int. Cl.[2] ..... F27D 23/00; F27B 21/00

[58] Field of Search ..... 432/5, 6, 10, 42, 65, 432/194, 226, 245, 249, 253, 256, 260

[56] References Cited

UNITED STATES PATENTS

| | | | |
|---|---|---|---|
| 2,815,197 | 12/1957 | Blackman et al. | 432/260 |
| 3,056,594 | 10/1962 | Blackman et al. | 432/260 |
| 3,081,074 | 3/1963 | Blackman et al. | 432/260 |
| 3,294,598 | 12/1966 | Norris | 432/10 |
| 3,386,721 | 6/1968 | Jones et al. | 432/260 |
| 3,596,891 | 8/1971 | Hill | 432/6 |
| 3,879,164 | 4/1975 | Haldopoulos et al. | 432/10 |
| 3,879,167 | 4/1975 | DeLuca et al. | 432/249 |

*Primary Examiner*—John J. Camby
*Assistant Examiner*—Henry C. Yuen
*Attorney, Agent, or Firm*—Bosworth, Sessions & McCoy

[57] ABSTRACT

Apparatus for and process of heat treating open coils of strip metal, such as strip steel, by passing hot gases or atmospheres through spaces between spaced convolutions of the coil, in which a shielding structure is provided at the upper end of the coil where the coil edge portions are exposed to radiant heat from the furnace and where they may tend to move and distort from gas velocity or localized thermal expansion. The shielding structure protects these portions of the coil from excessive heat and restricts harmful movement thereof, thus improving the quality of the heat treated product. The disclosed shielding structure comprises spaced upwardly extending walls the height of which is sufficient to, and the spacing of which is such as to, prevent direct impingement of radiant heat on the upper end of the coil while permitting adequate flow of gas through the shielding structure for treating purposes.

11 Claims, 3 Drawing Figures

FIG. 2.
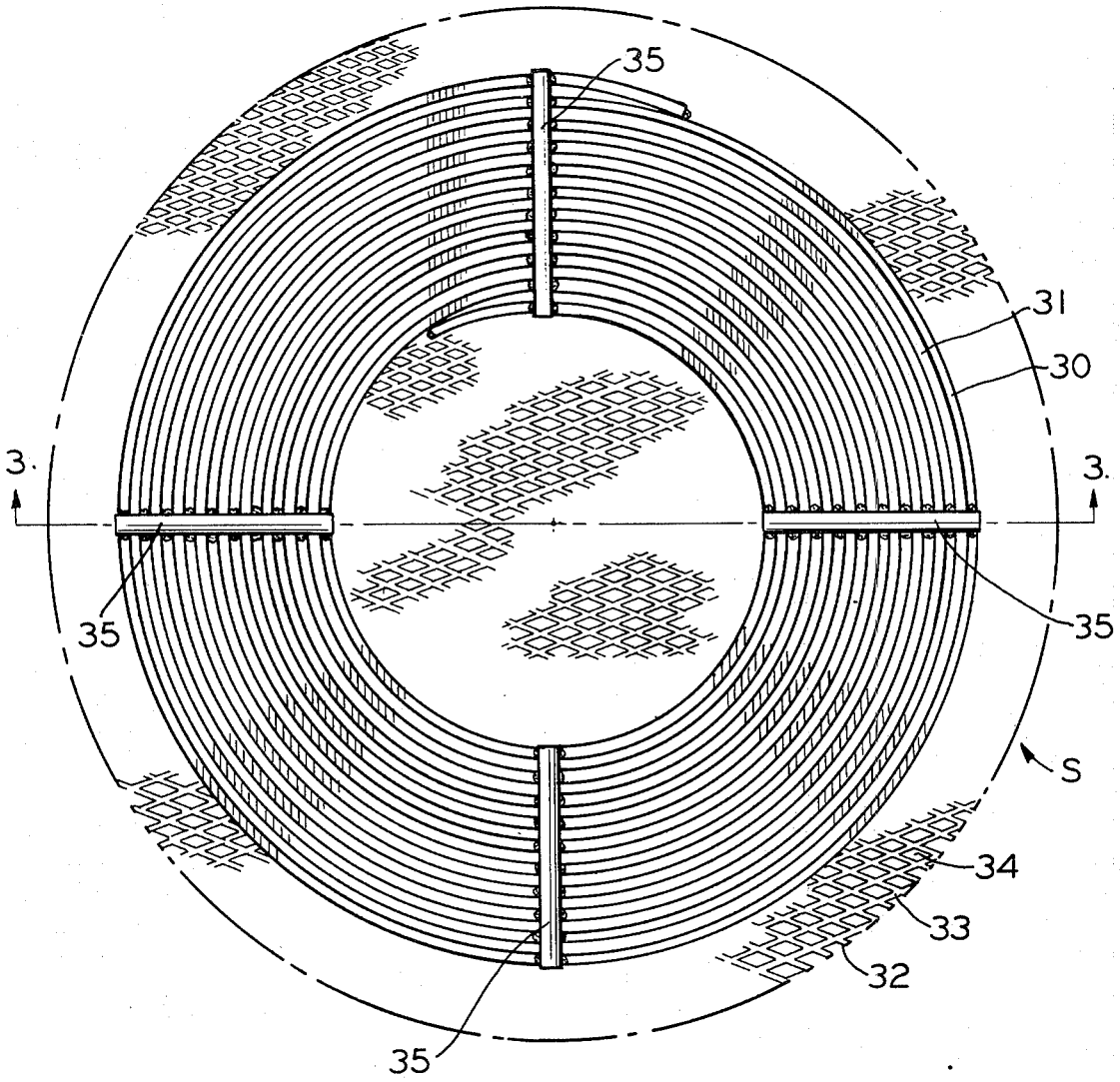
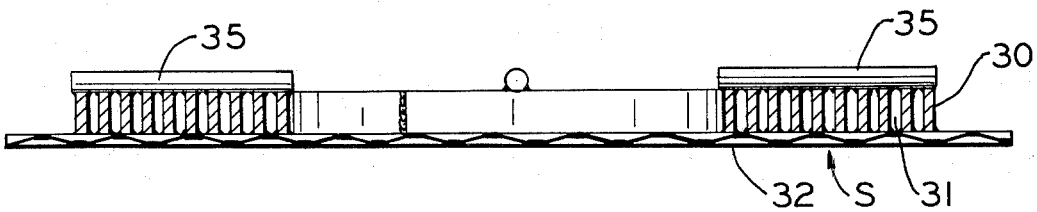
FIG. 3.

OPEN COIL HEAT SHIELDING

This is a division of application Ser. No. 465,428, filed Apr. 29, 1974, now U.S. Pat. No. 3,904,356.

BACKGROUND OF THE INVENTION

This invention relates to open coil heat treatment of strip metal and more particularly to a process for preventing undesirable distortion of an open coil during heat treatment.

The invention will be disclosed hereinafter in connection with the heat treatment of open coils of light gauge steel strip since it provides exceptional advantages in such use, although it may be used in the heat treatment of other strip material in open coils.

In the open coil heat treatment of such strip metal, a tight wound coil of strip metal is first recoiled into an open coil in which the spiral convolutions of strip metal in the coil are spaced apart. Such an open coil is then supported with its axis vertical on an open grid-like base structure and a suitable heated gas is caused to flow vertically either upwardly or downwardly outside and inside of the coil through the spaces between the convolutions of the coil to contact both sides of the metal strip and thus effectively heat the metal, as in the known process and apparatus disclosed in Wilson and Corns U.S. Pat. No. 3,114,539.

In heat treatment such as annealing, the steel strip in the coil may be heated to as high as 1750°F. by passing a suitable heated gas through the spaces between the convolutions of the coil. Other open coil treatments may involve modifying the chemical composition of the strip metal. For example, the carbon content of steel strip may be modified by the use of a suitable gas. Furthermore, treatments may involve oxidation, bright annealing, gas alloying and treatments involving the application to the surfaces of the strip metal of materials that will react with the constituents of the metal and the treatment of the surfaces by passing a suitable heated atmosphere between the spaced strip convolutions.

Since in open coil heat treatment, the lower edge portions of the convolutions of the open coil rest on a supporting grid or base, they satisfactorily maintain their original positions during heat treatment and are not harmfully disturbed by localized distortion of the metal due to thermal expansion or by the blast of heated atmosphere passing through the convolutions of the coil. However, when heat is applied by forcing heated atmosphere downwardly through the spaces between the convolutions from the top to the bottom of the open coil, the unsupported top edge portions of the spaced convolutions may flutter and move out of position due to the action of the high velocity stream of hot gas as it is forced down into the spaces between the coil convolutions. This may result in a permanent distortion of the upper edge portion of the strip which is difficult to remove and interferes with the proper recoiling of the heat treated opened coil back into tight wound form, and also with desired usage of the strip material.

Particular problems occur when the strip is of very light gauge, as from about 0.003 to 0.035 inch thick. In the absence of the present invention, strip steel of such small thickness is particularly susceptible to distortion at the upper end of the coil for the reasons indicated above, and because radiant heat transferred to the upper edge portions of the strip in the coil from the heated enclosure structure that is normally used around the coil in the heat treatment causes localized heating and thermal distortion of such edge portions of the coil.

Such permanent distortions of the edge portions of the coil are commonly referred to as "paneling" and cause the convolutions to contact each other so that all parts of the strip do not receive uniform treatment, cause difficulties in rewinding the strip into a tight coil, and reduce the quality of the product so it cannot be used for the desired purposes, as for example, for tinplate use.

SUMMARY OF THE INVENTION

The invention comprises a combination of an open coil of strip metal of a gauge such that the upper end portions of its convolutions are subject to distortion when exposed to heat treating atmosphere and, at the upper end of the coil, a heat shield comprising upwardly extending walls formed of metal of substantial thickness that will not substantially distort under the heating conditions to which it is subjected. These walls are usually of considerably smaller width than the width of the strip of which the open coil is formed, but are of sufficient width to prevent exposure of the upper portions of the coil to radiant heat directed laterally and downwardly from the enclosure in which the coil is contained while being heat treated. The spacing between and the thickness of the walls of the shielding structure are such as to allow the heat treating atmosphere to pass to or from the spaces between the convolutions of the open coil being treated without undesirable restriction of gas flow.

The invention also includes such a shielding structure, of substantial weight, that may have at its bottom a gas permeable, preferably planar, reinforcing member that distributes the weight of the shielding structure over the upper edges of the convolutions of the open coil when the shielding structure rests on the upper end of the coil and frictionally engages such edges to restrict their movement, while also providing an added shielding effect. Furthermore, this shielding structure preferably is formed of spiral convolutions of a strip or band of relatively thick metal of relatively narrow width as compared to the thickness and width of the strip of the open coil being protected.

The invention also includes a process of treating an open coil in an enclosure in which radiant heat is directed toward the upper edge portions of the convolutions of the open coil, and in which the upper edge portions of the open coil are shielded against such radiant heat.

By means of the apparatus and process of the present invention, paneling or other distortion of the upper edges of open coils being heat treated, particularly if they are of thin gauge, are substantially eliminated or greatly minimized, and the quality of the product is improved for this reason and because of the more uniform heat treatment of the convolutions of the open coil because uniform atmosphere flow therethrough is not disturbed.

Blackman and Beemer U.S. Pat. No. 3.056,594 discloses a coil stabilizer comprising prongs that extend between the coil convolutions to prevent distortions of the upper ends of the coil convolutions, but this patent does not disclose or suggest the apparatus and process of the present invention.

BRIEF DESCRIPTION OF THE DRAWINGS

The above and other advantages and features of the invention will be apparent from the following description of one apparatus embodiment of the invention in connection with the accompanying drawings in which:

FIG. 2 is a plan view, from line 2—2 of FIG. 1 and to a scale larger than that of FIG. 1, of a shielding structure embodying the invention, the thickness of the walls of the shielding structure and the spaces between them also being exaggerated; and FIG. 3 is a section along line 3—3 of FIG. 2 and to the same scale.

DESCRIPTION OF THE PREFERRED EMBODIMENT

Figure 1:
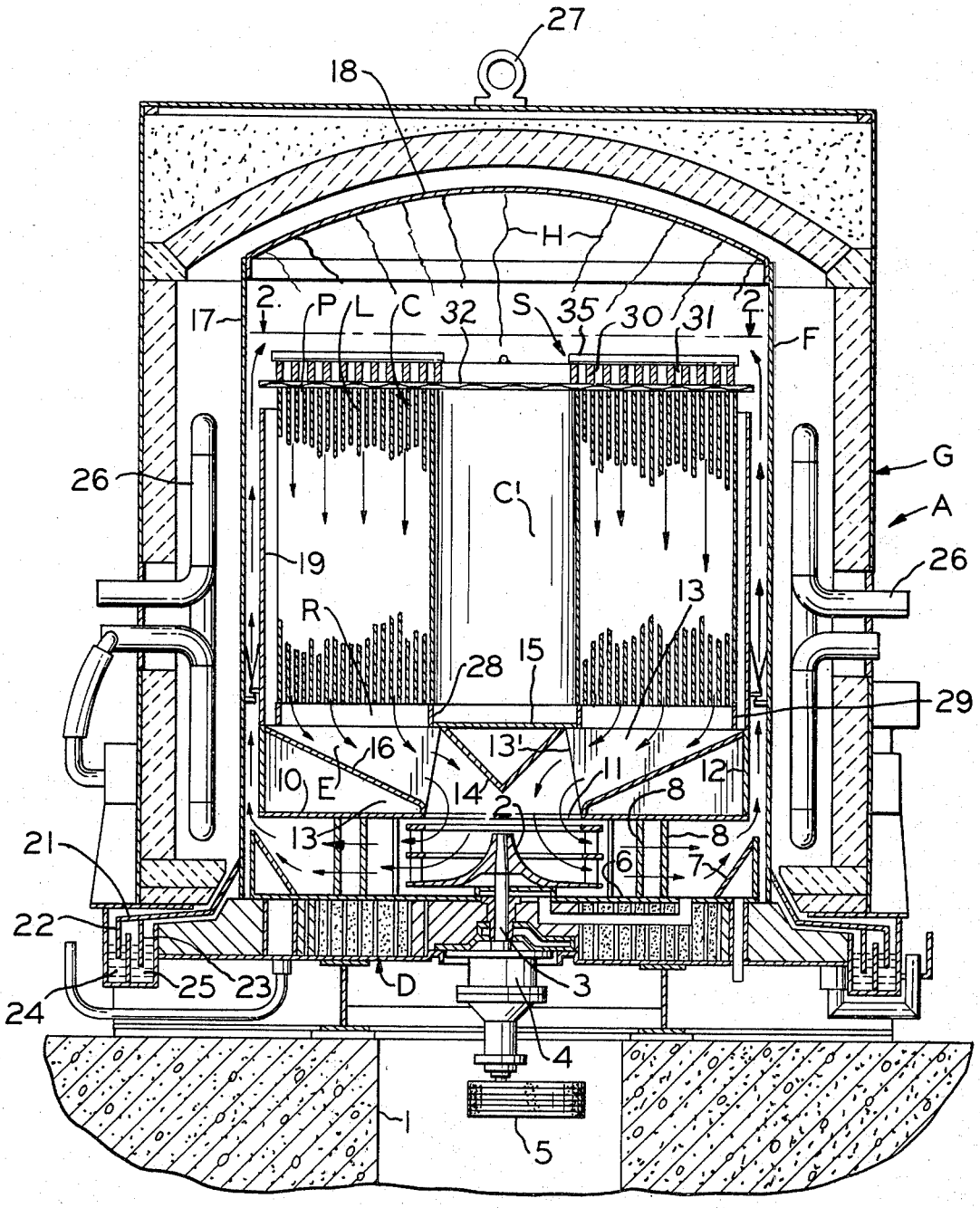
FIG. 1 is a vertical cross sectional view through a heat treating furnace and atmosphere circulating apparatus for heating and cooling an open coil having at its upper edge a shielding structure according to the invention, the thickness of the coil convolutions and the walls of the shielding structure and the spaces between them being exaggerated for the sake of clearness.

A furnace adapted to be used in connection with the apparatus of the invention and to carry out the process of the invention is illustrated in FIG. 1. This furnace is a bell-type furnace A adapted to heat treat an open coil C having at its upper edge a shielding structure S embodying the invention. The coil C is formed of spirally wound convolutions L of a metal strip, which convolutions are separated by spaces or passages P. The open coil may be formed by known means and methods.

The furnace A includes a base structure generally indicated at D, a plenum chamber generally indicated at E, an inner cover generally indicated at F and a furnace bell generally indicated at G.

The furnace base D is supported on a suitable foundation 1 and is adapted to carry the weight of coil being treated and the weight of the inner cover and the furnace bell. A centrifugal type fan or blower 2 has a vertical shaft 3 extending through the furnace base D and is supported in a suitable bearing 4. The lower end of shaft carries a pulley for the drive belt 5 which in turn is driven by a suitable motor (not shown).

Surrounding the fan 2 is a charge support and diffuser structure which includes a circular bottom plate 6, and an upwardly outwardly inclined generally conical gas diverting face 7. Bottom plate 6 is apertured for fan shaft 3, and also has a plurality of streamlined diffusing vanes 8 circumferentially arranged around, secured to, and extending vertically upwardly from the bottom plate 6. The inner ends of the vanes 8 closely approach the outer periphery of the fan 2.

Plenum chamber E is supported on top of the vanes 8, and comprises a circular base plate 10 having a circular central opening 11 located above fan 2 and having a diameter substantially equal to the fan inlet. A vertical cylindrical outer wall 12 is secured to plate 10 at its outer periphery, and a plurality of radially inwardly upstanding vertical fins 13 are welded to plate 10 and wall 12. The inner ends of the fins 13 are inclined as indicated at 13′ so their top edges are somewhat longer than their bottom edges. A conical flow guide member 14 is supported by the upper inner corners of the fins with its apex pointing downwardly toward the center of fan 2; a baffle plate 15 covers the upper end of the conical member 14. Inclined segmentally shaped plates 16 are located between and secured to each pair of fins 13 and are also secured to outer wall 12 and to base plate 10 adjacent its central opening 11. These segmental plates 16 reinforce and support the fins 13 and define, with conical member 14, the desired gas flow path to the upper inlet opening of fan 2.

Inner cover F is adapted to enclose the open coil being heat-treated and to retain the desired furnace atmosphere. It also facilitates the heating of the treating gas or atmosphere and its circulation into contact with the open coil being heat treated. As illustrated, the inner cover F consists of an open-bottomed generally cylindrical sheet metal structure having an outer wall 17, a closed top 18, and an inner wall 19 concentric with but inwardly spaced from outer wall 17. The lower end of outer wall 17 rests on the furnace base D. An outwardly extending skirt member 21 is carried by wall 17 and has downwardly extending cylindrical flanges 22 and 23 at its outer edge. These flanges fit in corresponding troughs 24 and 25 of the furnace base that are filled with liquid or sand to provide an effective gas seal to prevent undesired entry of outside atmosphere into the space within the inner cover F.

The cylindrical inner wall member 19 of the inner cover F is supported by the outer wall 17 for limited vertical movement relative thereto. As shown in FIG. 1, the inner wall 19 terminates short of the top and bottom of outer wall 17 and rests at its bottom edge on top of the outer wall 12 of the plenum chamber. Suitable lifting rings or the like (not shown) are provided on the inner cover F to facilitate its removal when it is desired to load or unload the furnace base.

The furnace bell G may be of any suitable and conventional form well known in this art. As illustrated, it consists of an insulated cylindrical structure closed at the top and open at the bottom. Heat is supplied to the furnace by a plurality of combustion tubes 26 supported in the wall of the bell and disposed around its inner surface. These tubes are supplied by suitable means, not shown, with a suitable mixture of fuel and air and indirectly furnish the heat necessary for the heat treating operation. When in operating position the bell G rests upon the furnace base B and may be removed for loading or unloading the furnace independently of the inner cover by the lifting eye 27.

In use of the furnace apparatus described above, the furnace bell G and the inner cover F are removed from the base B when an open coil is to be placed thereon for heat treating. An open coil C is transported to and positioned in a gas permeable supporting rack R with its axis substantially vertical. The center ring 28 of the rack R fits over and is centered by the center baffle plate 15 of the plenum chamber and the outer ring 29 of the rack lies within and spaced from the wall 19 of the inner cover F. The plate 15 and the ring 28 prevent flow of atmosphere through the center opening C′ of the coil C.

Next, the shield structure S is placed on the top of the open coil and the inner cover F and furnace bell G are then positioned as seen in FIG. 1; the apparatus is then ready for operation in well known manner.

During operation, the outer wall 17 of the inner cover F necessarily becomes heated to a substantially high temperature, so it can heat the treating gas or atmosphere that passes in contact with it. The upper portion of the inner cover F also becomes heated to substantially high temperature, and its inner surfaces tend to radiate substantial amounts of heat downwardly toward the upper portion of the coil being heat treated, as is generally indicated by the wavy lines H in FIG. 1. In the absence of the present invention, this radiant heat would strike the upper edge portions of the convolutions of the coil C and, particularly if the coil is of light gauge, provide substantial heat in addition to that which is provided by convection from the heated gas. This added heat may cause the temperatures of these upper portions of the convolutions to be substantially higher than the temperatures of the remaining portions and develop a substantial temperature gradient between the upper portions of convolutions and their lower portions. This temperature gradient causes localized thermal expansion of the coil convolutions which may cause the previously described distortions and paneling to occur, particularly if the temperatures of these upper edge portions of the convolutions pass through the critical zone of the metal.

However, according to the present invention, the deleterious effects of such radiant heat are greatly minimized or completely prevented by use of a shield structure S which, in the embodiment shown in the drawings, comprises walls 30 separated by spaces 31. The walls 30 are formed by the spirally wound convolutions of a strip or band of metal, the thickness of which, in order to provide the desired stiffness and rigidity to the shields, is usually substantially greater than the thickness of the metal in the open coil being treated. The spaces 31 between these convolutions are sufficient to permit an adequate flow of hot heating gas or atmosphere downwardly through these spaces and into the spaces P between the laps or convolutions L of the coil to perform the desired heat treatment of the coil. In the drawings the thickness of spaces 31 is shown as being preferably approximately the thickness of the walls 30 forming the convolutions; it may in some cases be less or greater than such thickness.

In the shielding structure S the width or height of the walls 30 is sufficiently great, and the spacing between the adjacent convolutions is sufficiently close, substantially to prevent radiant heat from the inner cover from directly striking the upper edge portions of the convolutions of the coil C which would otherwise be exposed and subjected to such heat. In the illustrated embodiment, the width of the spiral walls 30 of shielding structure S is considerably less than the width of the strip forming the convolutions of the open coil C. The width of the walls 30 of any particular shielding structure S may be varied depending on the width of the strip being treated and the intensity and direction of radiant heat that would otherwise strike the upper edge portions of the convolutions of the open coil C in the furnace for which the shield is designed.

The shielding structure S is also shown as including reinforcing or stiffening means in the form of a gas permeable, reticulated or grid-like planar base 32 secured, as by spot or tack welding, to at least some of the convolutions forming the walls 30 to provide a substantially rigid shielding structure. Base 32 is shown as being formed of expanded metal having metal bars 33 separated by openings 34, although it could be formed of other types of material providing a gas permeable structure. The base 32 holds the walls 30 of the shielding structure in place relative to each other while facilitating desired distribution of the substantial weight of the illustrated shielding structure S uniformly over the top of the open coil, thus avoiding damage to the upper edges of the open coil convolutions and by frictional engagement restricting their movement. The openings 34 through the base should be sufficiently large so as not to interfere harmfully with the flow of treating atmosphere.

In the illustrated embodiment, moreover, further reinforcing means in the form of radial bars 35 are welded to the tops of the walls 30 of the shielding structure to aid in stiffening the unit and also to facilitate handling of the shielding structure by means of a lifting magnet. The bars 35, of which four are shown in the illustrated embodiment, although another number may be used, are preferably of such small cross sectional width that they do not objectionably interfere with the gas flow.

The shielding structure S thus prevents the harmful effects of radiant heat on the upper portions of the open coil. Moreover, the substantial, but substantially uniformly distributed, weight of the structure S on the top edges of the convolutions of the open coil by frictional engagement restricts movement of such convolutions, and thus aids in elimination of paneling or other distortions that themselves could impair the quality of the product or that could impair flow of heat treating atmosphere so as thus to affect product quality adversely.

With the shielding structure S in place, in the assemblage of FIG. 1, the desired heat treating temperature is reached and maintained for the desired time by proper control of the heat applied through combustion tubes 26. Heating is then halted and the bell G is then removed. Circulation of gas within the inner cover is then maintained by the fan 2 during the following cooling portion of the cycle. The positive high velocity flow of cooling gas over substantially the entire surface of the strip with resulting extremely rapid transfer of heat from the coil to the outside atmosphere through the walls of the inner cover F, provides a desirably short cooling time.

After the desired cooling has been effected, the inner cover F is removed, the shielding structure S lifted off, and coil C removed from the furnace.

In an actual test a 30 inches wide steel strip having a thickness of 0.008 inch was heated by a suitable heat treating gas in a furnace of the above type according to a procedure like that disclosed above to a temperature of approximately 1550°F. and held at that temperature for a period of time sufficient to effect carburizing of the coil while a shielding structure like that disclosed was supported by the top of the open coil. There was no serious distortion of the open coil, the convolutions of which remained spaced apart. After the test, the upper portion of the open coil substantially retained the appearance of the remainder of the open coil.

It thus is apparent that the present invention provides a solution of a troublesome problem in open coil heat treatment, particularly of light gauge metals. Physical structure and metallurgical composition of the treated strip are more uniform and improved over those which would occur in the absence of the invention.

While the shielding structure illustrated embodies shield walls formed of the convolutions of a spirally wound strip, it is apparent that other types of protective walls may be used, even those that are not formed of spirally wound strips. While it is desirable to embody a permeable base, such as reticulated member 32, in the shielding structure, in some cases such a base may not be necessary. Moreover, while the shielding structure has been disclosed as formed of steel, it may be formed of other suitable materials that will withstand the heat treating conditions.

Furthermore, while the coil has been disclosed as heat treated by a suitable gas or atmosphere passing downwardly between the convolutions of the coil, the invention may be used in furnace apparatus and processes in which the gas flows upwardly between the coil convolutions.

Although in the above disclosure of the invention the shielding structure has been shown as being supported by the upper end of the open coil, it may be supported in shielding relation adjacent the upper end of the coil by other means, as by being supported from the inner cover F either by being suspended from the inner cover or supported therefrom by brackets. However, most advantageous results occur when the shielding structure is of substantial weight and rests on the upper edges of the coil convolutions so as to frictionally engage these edges and restrict or substantially prevent their movement.

Moreover, shielding structures embodying the invention may be used to prevent undesirable temperature gradients in the open coil that could cause harmful distortions of the coil convolutions and to inhibit movement thereof, during cooling of an open coil as well as during heating of an open coil.

Various modifications apparent to those skilled in the art, in addition to those indicated above, may be made in the apparatus, methods and products indicated above and changes may be made with respect to the features disclosed, provided that the elements set forth in the following claims or the equivalents of such be employed.

What is claimed is:

1. A process for heat treating an open coil having a free end and formed of convolutions of metal strip spirally wound about the axis of the coil and separated by spaces that permit passage of treating gas between such convolutions, which process comprises treating gas through said spaces between said convolutions of said coil under heat conditions including radiant heat that is directed from a source outside of said coil toward said free end of said coil and that tends to cause substantial distortions of the spaced free end portions of said spaced convolutions of said coil at said free end of said coil, and shielding said spaced free end portions of said coil from direct impingement of said radiant heat on said spaced free end portions of said coil while permitting adequate flow of treating gas through said radiant heat and between said coil convolutions for treating purposes, by interposing spaced shielding portions between said source of radiant heat and said free end of said coil that shield said spaced free end portions of said convolutions at said free end of said coil from direct impingement of said radiant heat while permitting flow of said gas between said spaced shielding portions sufficient to prevent harmful impending of flow of gas to or from between said convolutions.

2. The process of claim 1 in which during said process said coil is disposed upright with said free end of said coil at the top of said coil and said radiant heat is directed laterally of and toward said upper end of said coil, and in which said spaced shielding portions are interposed in an upright position and sufficiently close together to prevent direct impingement of said radiant heat on said spaced free end portions of said convolutions at said top of said coil.

3. A process for heat treating an open coil having a free end and formed of convolutions of metal strip spirally wound about the axis of the coil and separated by spaces that permit passage of treating gas between said convolutions, which process comprises passing treating gas through said spaces between said convolutions of said coil under heat conditions including heat directed from a source outside of said coil toward said free end of said coil that tends to cause substantial distortions of the free end portions of said convolutions of said coil at said free end of said coil, and shielding said free end portions of said coil against said heat conditions by interposing spaced shielding portions between said source and said free end of said coil that are sufficiently closely spaced to shield said free end portions of said convolutions of said coil adjacent said free end of said coil against said heat conditions while permitting flow of treating gas between said spaced shielding portions adequate to flow between said coil convolutions for treating purposes.

4. The process of claim 3 which is carried out while said coil is disposed with its axis upright and with said free end of said coil at the top of the coil and said shielding portions disposed adjacent said top free end of said coil.

5. The process of claim 3 in which said shielding portions include spaced walls that are interposed to extend generally axially of said coil for a sufficient distance with sufficient closeness of spacing to shield said free end portions of said convolutions of said coil at said free end of said coil from said heat conditions but permit adequate flow of treating gas between said convolutions of said coil.

6. The process of claim 5, which is carried out while said coil is disposed with its axis upright and said free end of said coil is at said top of said coil, in which said source of heat conditions causes radiant heat to be directed downwardly and substantially laterally toward the upper end portions of the convolutions of said coil at said free end of said coil, and in which said shielding portions are interposed to extend generally upright.

7. The process of claim 3 comprising the step of inhibiting movement of said free end portions of said convolutions of said coil at said free end of said coil.

8. The process of claim 7, comprising the step of frictionally engaging said free end portions of said convolutions of said coil by means supporting said shielding members, to inhibit movement of said free end portions of said convolutions.

9. A process for heat treating an open coil having a free end and formed of convolutions of metal strip spirally wound about the axis of the coil and separated by spaces that permit passing of treating gas between the convolutions, which process comprises passing treating gas through said spaces between said convolutions of said coil under heat conditions including radiant heat that is directed from a source outside of said coil toward said free end of said coil and that tends to cause substantial distortions of the spaced free end portions of said spaced convolutions of said coil at said free end of said coil, shielding said spaced free end portions of said convolutions of said coil from direct impingement of said radiant heat on said spaced free end portions of said convolutions of said coil while permitting adequate flow of treating gas through said radiant heat and between said coil convolutions for treating purposes, and restricting relative movement of said spaced free end portions of said convolutions of said coil at said free end of said coil.

10. A process for heat treating an open coil having a free end and formed of convolutions of metal strip spirally wound about the axis of the coil and separated by spaces that permit passage of treating gas between such convolutions, which process comprises passing treating gas through said spaces between said coil convolutions of said coil under heat conditions including radiant heat that is directed, from a source outside of said coil, laterally of and axially toward said free end of said coil and that tends to cause substantial distortions of the spaced free end portions of said spaced convolutions of said coil at said free end of said coil, and substantially completely shielding said spaced free end portions of said spaced convolutions of said coil from harmful direct impingement of said radiant heat on said spaced free end portions of said spaced convolutions of said coil while permitting adequate flow of treating gas through said radiant heat and between said coil convolutions for treating purposes.

11. The process of claim 10 is carried out while said coil is disposed with its axis upright with said free end of said coil at the top of said coil and while said radiant heat is directed laterally of and towards said free end of said coil, and in which process said spaced free end portions of said convolutions at the top of said coil are shielded from said radiant heat.

* * * * *